US011002161B2

(12) United States Patent
Ahmed et al.

(10) Patent No.: US 11,002,161 B2
(45) Date of Patent: May 11, 2021

(54) SWITCHABLE LEVER ARRANGEMENT

(71) Applicant: Schaeffler Technologies AG & Co. KG, Herzogenaurach (DE)

(72) Inventors: Faheem Ahmed, Rochester Hills, MI (US); Sumukha Nagaraj, Beverly Hills, MI (US); Béla Hofer, Veitsbronn (DE); David Chandler, Windsor (CA)

(73) Assignee: Schaeffler Technologies AG & Co. KG

( * ) Notice: Subject to any disclaimer, the term of this patent is extended or adjusted under 35 U.S.C. 154(b) by 110 days.

(21) Appl. No.: 16/426,003

(22) Filed: May 30, 2019

(65) Prior Publication Data

US 2019/0368392 A1 Dec. 5, 2019

Related U.S. Application Data

(60) Provisional application No. 62/680,112, filed on Jun. 4, 2018.

(51) Int. Cl.
*F01L 1/34* (2006.01)
*F01L 13/00* (2006.01)

(52) U.S. Cl.
CPC ..... *F01L 13/0015* (2013.01)

(58) Field of Classification Search
CPC ... F01L 13/0015; F01L 13/0005; F01L 1/185; F01L 2001/186; F01L 2820/03; F01L 2305/00; F01L 2820/032
See application file for complete search history.

(56) References Cited

U.S. PATENT DOCUMENTS 5,893,344 A * 4/1999 Church ..... F01L 1/183 123/198 F
2004/0069258 A1 4/2004 Kaczmarek et al.
2005/0092273 A1 5/2005 Cecur et al.

FOREIGN PATENT DOCUMENTS

WO 2017144706 A1 8/2017
WO 2017202845 A1 11/2017

* cited by examiner

*Primary Examiner* — Zelalem Eshete
(74) *Attorney, Agent, or Firm* — Matthew V. Evans

(57) ABSTRACT

A switchable lever arrangement is provided that includes at least one switchable lever and a rotary actuator. The at least one switchable lever includes an outer lever, an inner lever pivotably mounted to the outer lever, and a locking part that selectively locks the inner lever to the outer lever. The rotary actuator rotates about a rotational axis to actuate the locking part. The rotary actuator has a first locked position defined by a first effective actuation length, and a second unlocked position defined by a second effective actuation length, with the second actuation length different than the first actuation length.

19 Claims, 5 Drawing Sheets

SWITCHABLE LEVER ARRANGEMENT

TECHNICAL FIELD

The present disclosure is generally related to a valve train of an internal combustion (IC) engine, particularly switchable levers that are utilized in the valve train.

BACKGROUND

Levers are utilized within valve trains of IC engines to facilitate translation of rotary motion of a camshaft to linear motion of an intake or exhaust valve. Switchable levers can include a locking part that can lock or unlock an inner lever to an outer lever to achieve different discrete valve lifts. The locking part can be actuated by hydraulic fluid which can require a series of hydraulic fluid galleries arranged throughout an engine. The locking part can also be actuated by an electric actuator. Use of an electric actuator instead of actuation by hydraulic fluid can offer several advantages including, but not limited to, wider operating temperature range, elimination of hydraulic fluid oil galleries, and faster actuation times. Packaging space within an IC engine can be very limited for switchable lever systems.

SUMMARY

A switchable lever arrangement is provided that includes one or more switchable levers and a rotary actuator. The switchable lever includes an outer lever, an inner lever pivotably mounted to the outer lever, and a locking part capable of selectively locking the inner lever to the outer lever. The rotary actuator rotates about a rotational axis to actuate the locking part. The rotary actuator has a first locked position defined by a first effective actuation length of the rotary actuator relative to the rotational axis, and a second unlocked position defined by a second effective actuation length of the rotary actuator relative to the rotational axis, the second effective actuation length different than the first.

In one embodiment, the locking part includes a shuttle pin that is configured to engage the rotary actuator. The shuttle pin can be transverse to the switchable lever, and the rotational axis of the rotary actuator can be non-coaxial with a central axis of the shuttle pin.

The rotary actuator can include one or more fingers that are pivotably mounted to the rotary actuator, with the finger(s) configured to move to the first actuation length and the second actuation length by selective rotation of the rotary actuator. The rotary actuator can be electronically controlled.

In one embodiment, the switchable lever arrangement includes a first switchable lever and a second switchable lever, and the rotary actuator includes a first finger to actuate the first locking part of the first switchable lever, and a second finger to actuate the second locking part of the second switchable lever. A motion of one or both of the first or second fingers can be guided by a motion guide.

A switchable lever arrangement is provided that includes one or more switchable levers. The switchable lever includes an outer lever, an inner lever pivotably mounted to the outer lever, a locking part capable of selectively locking the inner lever to the outer lever, and a rotary actuator. The rotary actuator rotates about a rotational axis to actuate the locking part and continuously increases or decreases in effective actuation length as it moves from a first rotational angle to a second rotational angle. The rotary actuator can engage a portion of the locking part that moves within a first bore arranged transversely to the switchable lever. In one embodiment, the rotational axis is non-coaxial to the central axis of the first bore.

In one embodiment, the locking part can include a shuttle pin that moves within the first bore, and a locking pin that moves within a second bore, with the second bore orthogonal to the first bore.

In one embodiment, the rotary actuator includes one or more fingers that: (i) retract to a first effective actuation length to achieve a first locked position; and, (ii) extend to a second effective actuation length to achieve a second unlocked position. The first locked position can define a first valve lift mode and the second unlocked position can define a second valve lift mode. The first valve lift mode can be a full-valve-lift mode, and the second valve lift mode can be a no-valve-lift mode.

An actuator for a switchable valve train arrangement is provided that includes a rotary platform that is configured to rotate around a rotational axis to actuate a locking part of a switchable valve train component. The rotary platform has a first locked position defined by a first effective actuation length of the rotary platform relative to the rotational axis, and a second unlocked position defined by a second effective actuation length of the rotary platform relative to the rotational axis. The rotary platform can include one or more fingers pivotably mounted to the rotary platform. The finger can include a guide surface adapted to engage a motion guide, and a first end adapted to engage the locking part of the switchable valve train component. The actuator can include a solenoid that rotationally actuates the rotary platform.

A method of actuating a switchable valve train component is provided that includes:

1). Providing: a). a switchable valve train component having a first component, a second component, and a locking part that selectively locks the first component to the second component; and, b). a rotary actuator that rotates about the rotational axis to actuate the locking part.

2). Rotating the rotary actuator to continuously decrease an effective actuation length of the rotary actuator to move the locking part to a first locked position; and, 3). Rotating the rotary actuator to continuously increase an effective actuation length of the rotary actuator to move the locking part to a second unlocked position.

BRIEF DESCRIPTION OF THE DRAWINGS

The foregoing Summary as well as the following Detailed Description will be best understood when read in conjunction with the appended drawings. In the drawings.

DETAILED DESCRIPTION OF EMBODIMENTS

Figure 1:
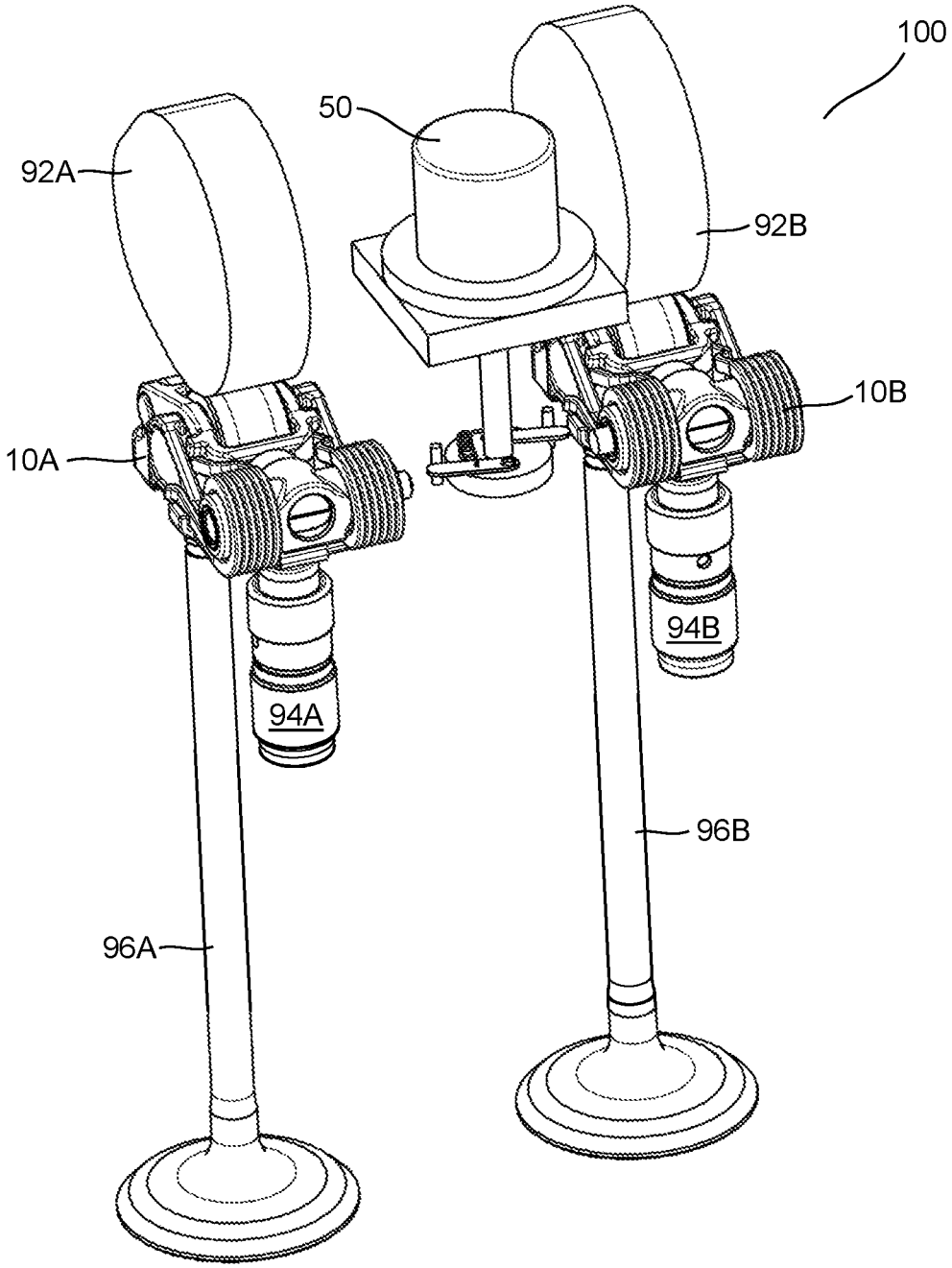
FIG. 1 is a perspective view of an example embodiment of a switchable valve train system that includes an actuator, a first switchable lever, a second switchable lever, a first camshaft lobe, a second camshaft lobe, a first pivot element, a second pivot element, a first engine valve, and a second engine valve.

Certain terminology is used in the following description for convenience only and is not limiting. The words "inner," "outer," "inwardly," and "outwardly" refer to directions towards and away from the parts referenced in the drawings. A reference to a list of items that are cited as "at least one of a, b, or c" (where a, b, and c represent the items being listed) means any single one of the items a, b, c or combinations thereof. The terminology includes the words specifically noted above, derivatives thereof, and words of similar import.

Figure 2:
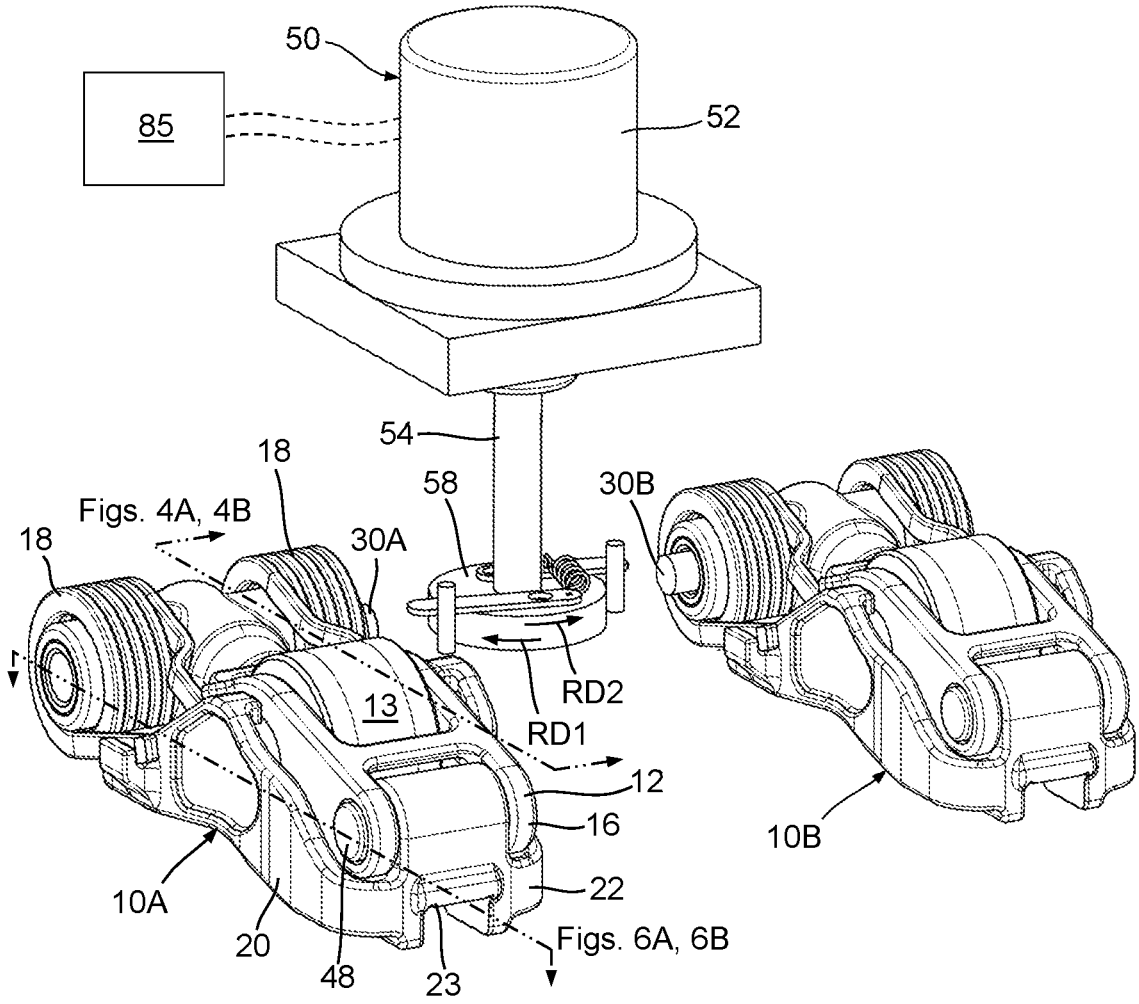
FIG. 2 is a perspective view of the first switchable lever, second switchable lever, and actuator of FIG. 1.
Figure 3:
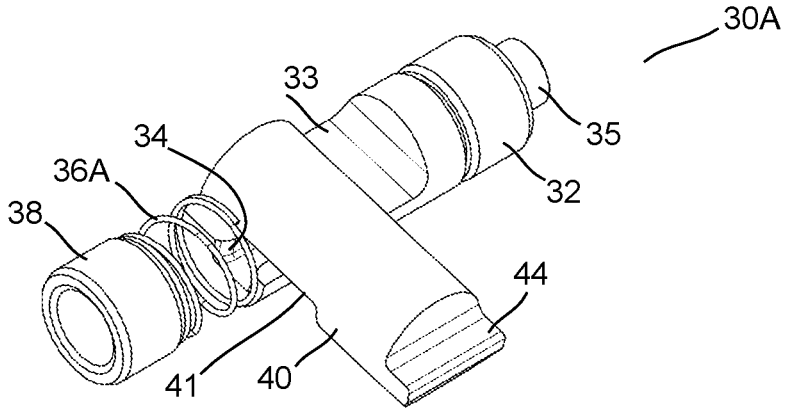
FIG. 3 is a perspective view of a first locking part of the first switchable lever of FIG. 2.
Figure 4A:
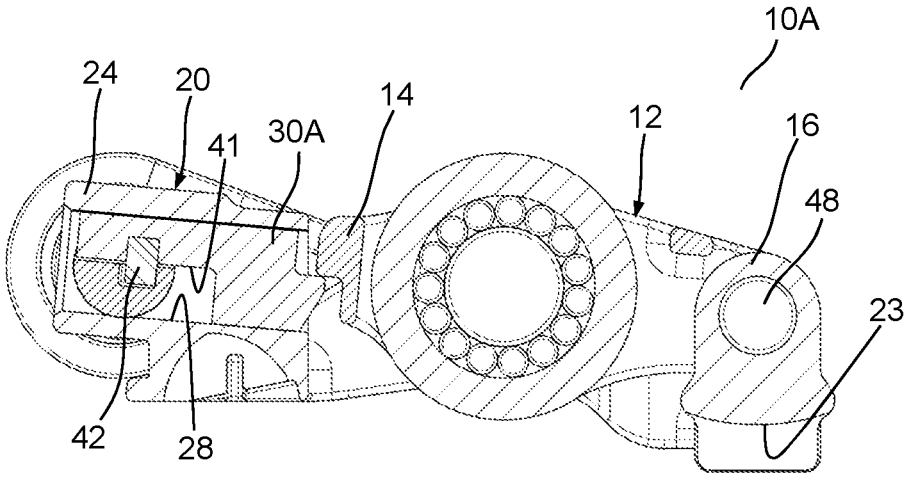
FIG. 4A is a cross-sectional view of the first switchable lever of FIG. 2 in a first locked position.
Figure 4B:
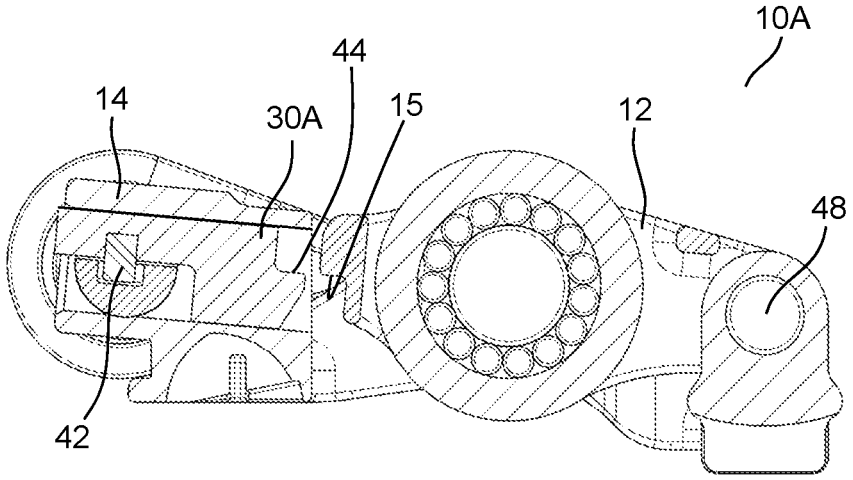
FIG. 4B is a cross-sectional view of the first switchable lever of FIG. 2 in a second unlocked position.
Figure 5A:
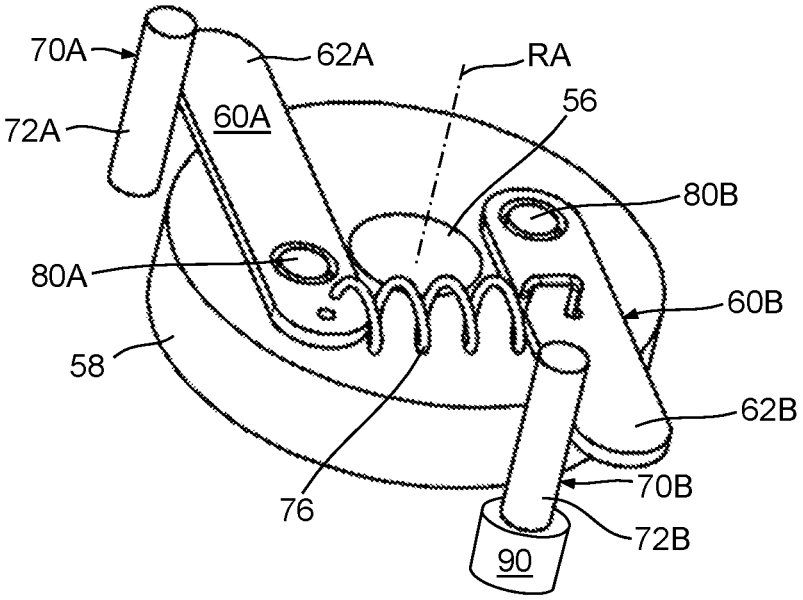
FIG. 5A is an isometric view of a rotary platform of the actuator of FIG. 2.
Figure 5B:
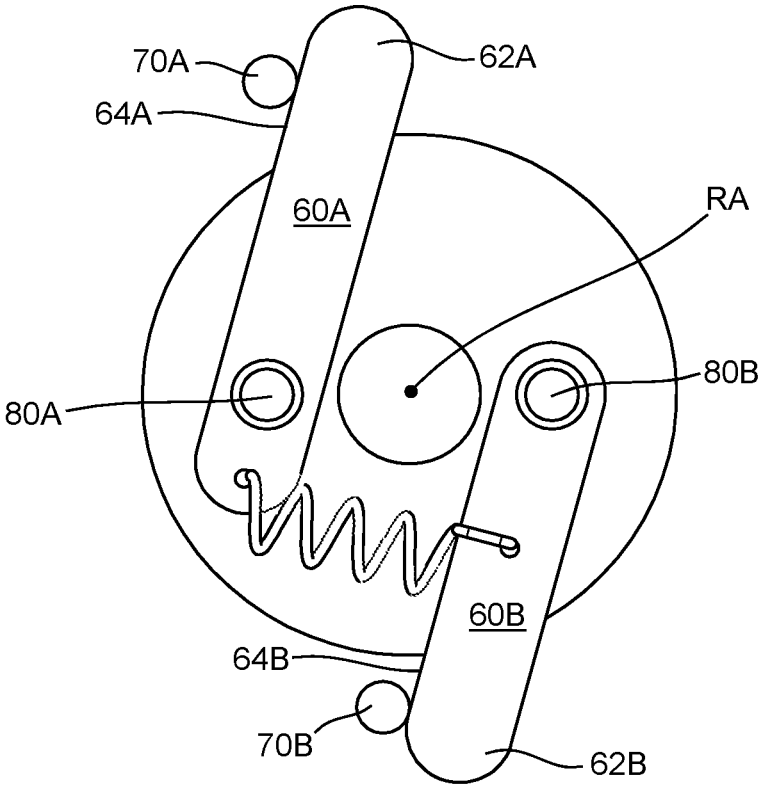
FIG. 5B is a top view of the rotary platform of FIG. 5A.
Figure 6A:
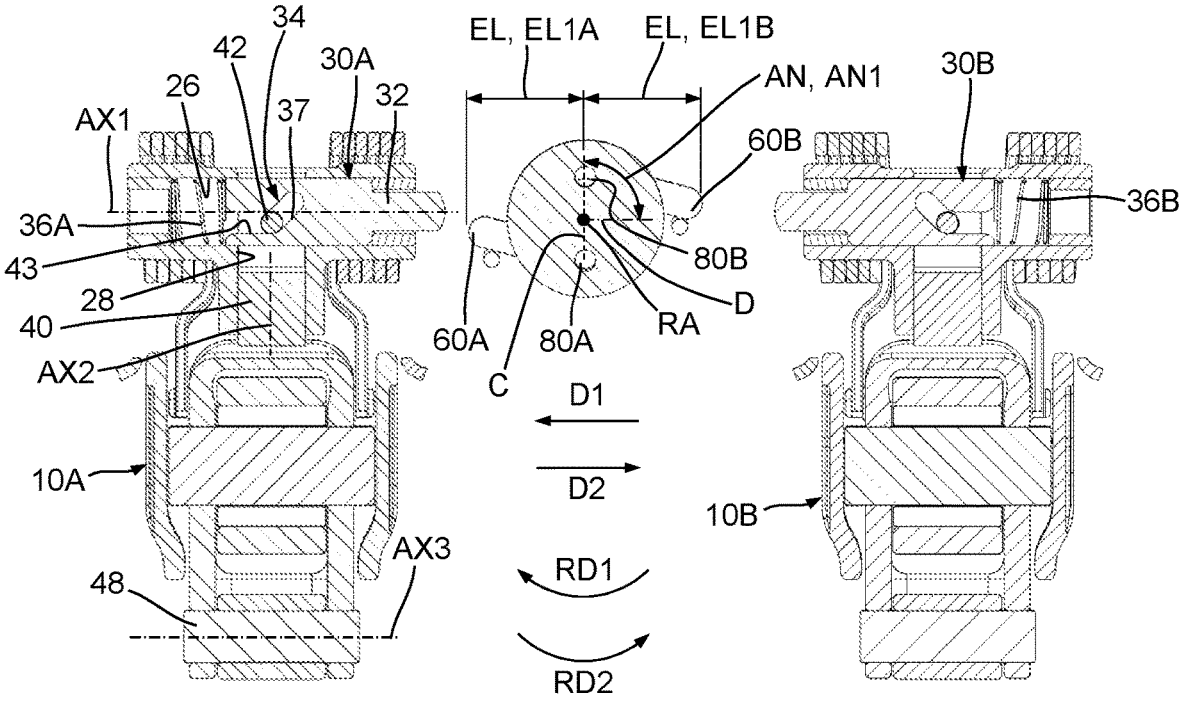
FIG. 6A is a cross-sectional view of the first and second switchable levers and the actuator of FIG. 2 in a first locked position.
Figure 6B:
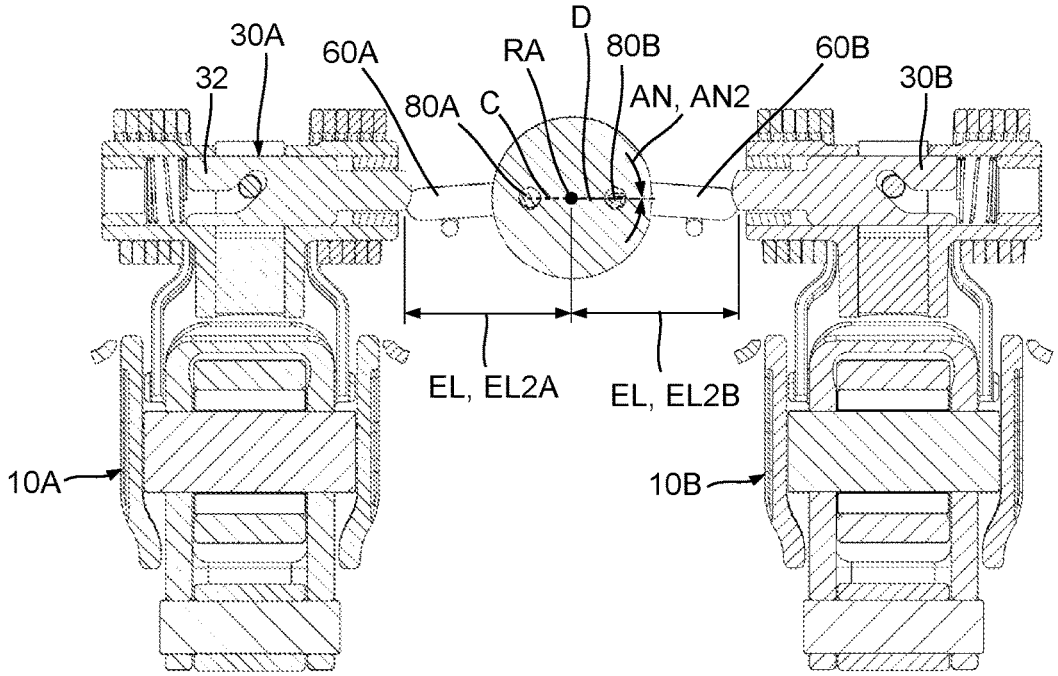
FIG. 6B is a cross-sectional view of the first and second switchable levers and the actuator of FIG. 2 in a second unlocked position.

FIG. 1 shows a perspective view of an example embodiment of a switchable valve train system 100 that includes a rotary actuator 50, a first switchable lever 10A, a second switchable lever 10B, a first camshaft lobe 92A, a second camshaft lobe 92B, a first pivot element 94A, a second pivot element 94B, a first engine valve 96A, and a second engine valve 96B. FIG. 2 shows a perspective view of the first and second switchable levers 10A, 10B and the rotary actuator 50 of FIG. 2. FIG. 3 is a perspective view of a first locking part 30A of the first switchable lever 10A of FIG. 2. FIGS. 4A and 4B show cross-sectional views of the first switchable lever 10A of FIG. 2 in a respective first locked position and a second unlocked position. FIG. 5A is an isometric view of a rotary platform 58 of the rotary actuator 50 of FIG. 2, while FIG. 5B is a top view of the rotary platform 58 of FIG. 5A. FIGS. 6A and 6B show cross-sectional views of the first and second switchable levers 10A, 10B and the rotary actuator 50 in respective first locked and second unlocked positions. The following discussion should be read in light of FIGS. 1 through 6B.

The rotary actuator 50 is arranged between the first switchable lever 10A and the second switchable lever 10B, having access to a first locking part 30A and a second locking part 30B of the respective first and second switchable levers 10A, 10B. It could also be stated that portions of the first and second locking parts 30A, 30B are exposed to receive an actuation force from outside of the first and second switchable levers 10A, 10B. Other than an orientation of the first locking part 30A and second locking part 30B such that they are accessible by the rotary actuator 50 placed between them, the first switchable lever 10A and the second switchable lever 10B are identical in design, utilizing the same components; however, different switchable lever designs are possible within the switchable valve train system 100. A functional description now follows for the first switchable lever 10A, which can also be applied to the second switchable lever 10B.

The first switchable lever 10A includes an outer lever 20 and an inner lever 12. The inner lever 12 is pivotably mounted to the outer lever 20 by a pivot axle 48. The first locking part 30A can selectively lock the inner lever 12 to the outer lever 20. The inner lever 12 includes a locking end 14 with a locking surface 15 and a hinge end 16 that receives the pivot axle 48. A roller follower 13 is located between the locking end 14 and the hinge end 16, which interfaces with the first camshaft lobe 92A to translate rotary motion of the first camshaft lobe 92A to linear motion of the first engine valve 96A when the inner lever 12 is locked to the outer lever 20. The roller follower 13 could also be replaced by an optional slider interface. The outer lever 20 includes a valve end 22 with a valve interface 23, and a pivot end 24 that houses the first locking part 30A.

The first switchable lever 10A utilizes lost motion springs 18 that have a first end connected to the inner lever 12 and a second end connected to the inner lever. The lost motion springs 18 primarily function when the inner lever 12 is unlocked from the outer lever 20. During this unlocked state, the lost motion springs 18 provide a force that can: 1). act upon the inner lever 12 to provide a controlled motion of the inner lever 12 to prevent separation with the first camshaft lobe 92A at a maximum unlocked mode speed, and 2). act upon the outer lever 20 to prevent a pump-up or extended length condition of the first pivot element 94A, which could hinder the switching function of the first switchable lever 10A.

The first locking part 30A includes a shuttle pin 32, a first return spring 36A, a retaining cap 38, and a locking pin 40. Several other forms of the first locking part 30A are possible that include additional components or a reduced number of components. The shuttle pin 32 moves within a first bore 26 that is arranged at the pivot end 24 of the outer lever 20. The first bore 26, and, thus, the shuttle pin 32 are arranged transverse to the switchable lever 10A. The term "transverse" is meant to describe a path or direction that runs across the switchable lever; stated otherwise, a first axis AX1 of the first bore 26 is parallel to a third axis AX3 of the pivot axle 48 (see FIG. 6A).

The locking pin 40 moves within a second bore 28 that is orthogonal to the first bore 26, meaning that a second axis AX2 of the second bore 28 can be perpendicular to the first axis AX1 without being coplanar. The locking pin 40 moves within the second bore 28 when the shuttle pin 32 moves within the first bore 26 via actuation by the rotary actuator 50. Stated otherwise, movement of the shuttle pin 32, caused by the rotary actuator 50, along the first axis AX1 that is transverse to the first switchable lever 10A, induces movement of the locking pin 40 along the second axis AX2 that is orthogonal to the first axis AX1. Translation of shuttle pin movement to locking pin movement, which could also be described as translation of transverse movement to longitudinal movement, is accomplished by a cam-and-follower type arrangement, as shown in FIGS. 3, 6A and 6B. The shuttle pin 35 is configured with a first flat 33 that slidably engages a second flat 41 of the locking pin 40. An actuation groove 34 is formed within the first flat 33 of the shuttle pin 35 that receives a protrusion 42 that extends from the second flat 41 of the locking pin 40. The actuation groove 34 includes a straight portion 43 and a ramp portion 37 that, depending on a direction of travel of the shuttle pin 32, either pushes or pulls the locking pin 40 into a first locked position or a second unlocked position, respectively. Many other design means for translating motion from the shuttle pin 32 to the locking pin 40 are also possible.

With reference to FIG. 6A and the first switchable lever 10A on the left side, the first locked position of the first locking part 30A is shown, in which the first return spring 36A urges the shuttle pin 32 to a right-most stop position. In the first locked position, the protrusion 42 of the locking pin 40 is located at a beginning of the ramp portion 37 (or an end of the straight portion 43) of the actuation groove 34. In the first locked position, the rotary actuator 50 is in a position in which it allows the shuttle pin 32 to remain at its right-most stop position. In the first locked position, the locking in 40 extends into the inner lever 12, such that a latching flat 44 of the locking pin 40 is proximate to the locking surface 15 of the inner lever 12 (see FIGS. 4A and 4B). The latching flat 44 is configured to engage the locking surface 15 during a valve lift event. The components and positions of the rotary actuator 50 will be further described in the paragraphs below.

With reference to FIG. 6B and the first switchable lever 10A on the left side, the second unlocked position of the first locking part 30A is shown, in which the shuttle pin 32 is displaced to the left within the first bore 26 by the rotary actuator 50. In the second unlocked position, the protrusion 42 of the locking pin 40 is engaged with the ramp portion 37 of the actuation groove 34, causing the shuttle pin 32 to pull or retract the locking pin 40 from the inner lever 12.

The rotary actuator 50 can have many different forms and configurations. The term "actuator" is used throughout the specification and claims and is intended to define a component, or assembly of components that actuates the first and/or second switchable levers 10A, 10B, or any other switchable valve train component.

The rotary actuator 50 includes a rotary platform 58 that is rotationally actuated about a rotational axis RA by a solenoid 52. The rotational axis RA of the rotary actuator 50 is non-concentric to the first axis AX1 of the first bore 26, and, therefore, also non-concentric to a central axis of the shuttle pin 32 that can be engaged by the rotary actuator 50. Control of the rotary actuator 50 (energizing and timing thereof) can be accomplished by an electronic controller 85 that can communicate electronically with the actuator 50. A connector post 54 can connect the rotary platform 58 to the solenoid 52 via a post aperture 56 arranged in the rotary platform 58. The rotary platform 58 can include a first finger 60A, a second finger 60B and a tension spring 76. The first finger 60A and the second finger 60B are pivotably mounted to the rotary platform 58 at respective first and second pivoting connections 80A, 80B. The first and second pivoting connections 80A, 80B can be facilitated by a pressed-in or staked cylindrical pin, however, any design that suits the function of a pivoting connection is possible.

With specific reference to FIGS. 6A and 6B, upon rotation of the rotary platform 58 around the rotational axis RA in a first rotational direction RD1 or a second rotational direction RD2, the first and second fingers 60A, 60B are either moved closer to the first and second switchable levers 10A, 10B or retracted so that they are further away. Stated more specifically, upon rotation in a first rotational direction RD1, the following can occur: 1). the first finger 60A engages the first locking part 30A such that the first locking part 30A is displaced in a first direction D1 by a first end 62A of the first finger 60A; and, 2). the second finger 60B engages the second locking part 30B such that the second locking part 30B is displaced in a second direction D2 by a first end 62B of the second finger 60B. Upon rotation in a second rotational direction RD2, the following can occur: 1). the first finger 60A moves away from the first locking part 30A such that the first locking part 30A moves in the second direction D2; this movement can be assisted by the first return spring 36A arranged within the first locking part 30A, or by some other means; and, 2). the second finger 60B moves away from the second locking part 30B such that the second locking part 30B moves in the first direction D1; this movement can also be assisted by a second return spring 36B arranged within the second locking part 30B.

Although not shown in the Figures, at least a portion of the first and second fingers 60A, 60B could be resiliently configured to eliminate or reduce any lash or space between the fingers 60A, 60B and the respective first and second locking parts 30A, 30B while in the first locked position. In an example embodiment, the first end 62A of the first finger 60A could be spring-loaded, and the first end 62B of the second finger 60B could be spring-loaded, such that when the fingers 60A, 60B are retracted to achieve the first locked position, each of the respective first ends 62A, 62B remains engaged with the respective first and second locking parts 30A, 30B.

Each of the motion paths of the first and second fingers 60A, 60B is guided by respective first and second motion guides 70A, 70B that can be received by or formed within a cylinder head 90 of an IC engine or any other receiving structure. The tension spring 76 (at least one) is connected to the first and second fingers 60A, 60B to provide a guiding force that induces a sliding connection between the first and second fingers 60A, 60B and their respective first and second motion guides 70A, 70B; more specifically, this sliding connection occurs between a first guide surface 64A of the first finger 60A and a first outer surface 72A of the first motion guide 70A; and, a second guide surface 64B of the second finger 60B and a second outer surface 72B of the second motion guide 70B.

Rotation of the rotary actuator 50 in either first or second rotational directions RD1, RD2 to any rotational angle AN achieves continuously variable effective actuation lengths EL of the rotary actuator. The rotational angle AN is defined as an angle between a horizontal datum line D and a connector line C that connects the centers of the first and second pivoting connections 80A, 80B. Effective actuation lengths EL are defined as a distance from the rotation axis RA of the rotary actuator 50 to an outermost surface of one or both of the first and second fingers 60A, 60B that contacts respective one or both of the first and second locking parts 30A, 30B.

As shown in FIG. 6A, a first effective actuation length EL1A is achieved for the first finger 60A when the rotary actuator 50 is at a first rotational angle AN1 of 90 degrees. Likewise, a first effective actuation length EL1B is achieved for the second finger 60B when the rotary actuator 50 is at the first rotational angle AN1 of 90 degrees. As shown, the first effective actuation lengths EL1A, EL1B for the respective first and second fingers 60A, 60B are equal, however, the rotary actuator 50 and first and second fingers 60A, 60B could be designed to provide different effective actuation lengths (EL1A≠EL1B) for each finger at any rotational angle of the rotary actuator 50.

With reference to FIG. 6B, a second effective actuation length EL2A is achieved for the first finger 60A when the rotary actuator 50 is at a second rotational angle AN2 of zero degrees. Likewise, a second effective actuation length EL2B is achieved for the second finger 60B when the rotary actuator is at a rotational angle AN1 of zero degrees. In the example embodiment shown in the Figures, the second effective actuation lengths EL2A, EL2B are longer than the first effective actuation lengths EL1A, EL1B.

It is also possible to design the rotary actuator 50 and corresponding first and second levers 10A, 10B such that an increased effective actuation length EL (such as EL2A, EL2B) provides for the first locked position, and a decreased effective actuation length EL (such EL1A, EL1B) provides for the second unlocked position.

FIGS. 6A and 6B show two discrete rotational angles AN1, AN2 of the rotary actuator 50. As the rotary actuator 50 moves from the first rotational angle AN1 to the second rotational angle AN2, an effective actuation length EL for the first and second fingers 60A, 60B continuously increases in length. Likewise, as the actuator moves from the second rotational angle AN2 to the first rotational angle AN1, an effective actuation length for the first and second fingers 60A, 60B continuously decreases in length. Stated otherwise, as the rotary actuator 50 rotates from the first rotational angle AN1 to the second rotational angle AN2, it yields all effective actuation lengths that reside between the first and second effective actuation lengths EL1A, EL1B for the first finger 60A, and likewise, any effective actuation length EL that resides between the first and second effective actuation lengths EL2A, EL2B for the second finger 60B. Stated yet in another way, as the rotary actuator 50 rotates in the first rotational direction RD1, the first ends 62A, 62B of the respective first and second fingers 60A, 60B move away from the rotational axis RA; additionally, as the rotary actuator 50 rotates in the second rotational direction RD2, the first ends 62A, 62B of the respective first and second fingers 60A, 60B are retracted, or move closer to the rotational axis RA.

FIGS. 4A, 6A show the first locked position of the first switchable lever 10A and its respective first locking part 30A, achieved by the first rotational angle AN1 of the rotary actuator 50; and FIGS. 4B, 6B show the second unlocked position of the first switchable lever 10A and its respective first locking part 30A, achieved by the second rotational angle AN2 of the rotary actuator 50. The first locked position can enable a first valve lift mode and the second unlocked position can enable a second valve lift mode. The first valve lift mode can be a full-valve-lift mode, and the second valve lift mode can be a no-valve-lift mode. The no-valve-lift mode can be described as a valve deactivation mode.

From the previously described arrangement and operation of the switchable valve train system 100, the following describes a method of actuating a switchable valve train component. Although the method is presented as a sequence of steps for clarity, no order should be inferred from the sequence unless explicitly stated.

A first step includes providing: a). a switchable valve train component having a first component, a second component, and a locking part that selectively locks the first component to the second component; and, b). a rotary actuator that rotates about the rotational axis to actuate the locking part.

A second step includes rotating the rotary actuator to continuously decrease an effective actuation length of the rotary actuator to move the locking part to a first locked position; and, A third step includes rotating the rotary actuator to continuously increase an effective actuation length of the rotary actuator to move the locking part to a second unlocked position.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

What is claimed is:

1. A switchable lever arrangement comprising:
at least one switchable lever including:
an outer lever;
an inner lever pivotably mounted to the outer lever;
a locking part capable of selectively locking the inner lever to the outer lever;
a rotary actuator that rotates about a rotational axis to actuate the locking part, the rotary actuator having:
a first locked position defined by a first effective actuation length of the rotary actuator relative to the rotational axis; and,
a second unlocked position defined by a second effective actuation length of the rotary actuator relative to the rotational axis, the second effective actuation length different than the first effective actuation length.

2. The switchable lever arrangement of claim 1, wherein the locking part comprises a shuttle pin that is configured to engage the rotary actuator.

3. The switchable lever arrangement of claim 2, wherein the shuttle pin is transverse to the at least one switchable lever.

4. The switchable lever arrangement of claim 2, wherein the rotational axis of the rotary actuator is non-coaxial with a central axis of the shuttle pin.

5. The switchable lever arrangement of claim 1, wherein the rotary actuator includes at least one finger that is pivotably mounted to the rotary actuator, the at least one finger configured to move to the first effective actuation length and the second effective actuation length by selective rotation of the rotary actuator.

6. The switchable lever arrangement of claim 5, wherein a motion of the at least one finger is configured to be guided by a motion guide.

7. The switchable lever arrangement of claim 5, wherein:
the at least one switchable lever comprises a first switchable lever and a second switchable lever; and,
the at least one finger comprises a first finger and a second finger, the first finger to actuate a first locking part of the first switchable lever, and the second finger to actuate a second locking part of the second switchable lever.

8. A switchable lever arrangement comprising:
at least one switchable lever including:
an outer lever;
an inner lever pivotably mounted to the outer lever;
a locking part capable of selectively locking the inner lever to the outer lever; and,
a rotary actuator that rotates about a rotational axis to actuate the locking part, the rotary actuator continuously increasing or decreasing in actuation length as it moves from a first rotational angle to a second rotational angle.

9. The switchable lever arrangement of claim 8, wherein the rotary actuator is electronically controlled.

10. The switchable lever arrangement of claim 8, wherein the rotary actuator engages a portion of the locking part that moves within a first bore arranged transversely to the switchable lever.

11. The switchable lever arrangement of claim 10, wherein the rotational axis is non-coaxial to a central axis of the first bore.

12. The switchable lever arrangement of claim 11, wherein the locking part comprises:

a shuttle pin that moves within the first bore; and, a locking pin that moves within a second bore, the second bore orthogonal to the first bore.

13. The switchable lever arrangement of claim 12, wherein the rotary actuator includes at least one finger that: (i) extends to a first effective actuation length to achieve a first locked position; and, (ii) retracts to a second effective actuation length to achieve a second unlocked position.

14. The switchable lever arrangement of claim 13, wherein the first locked position defines a first valve lift mode and the second unlocked position defines a second valve lift mode.

15. The switchable lever arranged of claim 14, wherein the first valve lift mode is a full-valve-lift mode, and the second valve lift mode is a no-valve-lift mode.

16. An actuator for a switchable valve train arrangement, the actuator comprising:

a rotary platform configured to rotate around a rotational axis to actuate a locking part of a switchable valve train component, the rotary platform having:

at least one finger pivotable mounted to the rotary platform;

a first locked position defined by a first effective actuation length of the rotary platform relative to the rotational axis; and, a second unlocked position defined by a second effective actuation length of the rotary platform relative to the rotational axis.

17. The actuator of claim 16, wherein the at least one finger includes:

a guide surface adapted to engage a motion guide; and, a first end adapted to engage the locking part of the switchable valve train component.

18. The actuator of claim 16, further comprising a solenoid that rotationally actuates the rotary platform.

19. A method of actuating a switchable valve train component, comprising:

providing:

the switchable valve train component, having:

a first component;

a second component; and, a locking part that selectively locks the first component to the second component;

a rotary actuator that rotates about a rotational axis to actuate the locking part;

rotating the rotary actuator to variably decrease an effective actuation length of the rotary actuator to move the locking part to a first locked position; and, rotating the rotary actuator to variably increase the effective actuation length of the rotary actuator to move the locking part to a second unlocked position.

* * * * *